US009810427B2

(12) United States Patent
Fernandes et al.

(10) Patent No.: US 9,810,427 B2
(45) Date of Patent: Nov. 7, 2017

(54) FUEL NOZZLE WITH HEMISPHERICAL DOME AIR INLET

(71) Applicant: ANSALDO ENERGIA SWITZERLAND AG, Baden (CH)

(72) Inventors: Luiz Claudio Fernandes, Palm Beach Gardens, FL (US); Brian Richardson, Jupiter, FL (US); Peter Stuttaford, Jupiter, FL (US); Sumit Soni, Jupiter, FL (US); David Schlamp, Jupiter, FL (US); Chiluwata Lungu, Atlanta, GA (US); Justin Bosnoian, Juno Beach, FL (US); Nicolas Demougeot, Stuart, FL (US); Kevin B. Powell, Jupiter, FL (US); Brandon Hill, Jensen Beach, FL (US); Marc Paskin, Parkland, FL (US)

(73) Assignee: ANSALDO ENERGIA SWITZERLAND AG (CH)

( * ) Notice: Subject to any disclaimer, the term of this patent is extended or adjusted under 35 U.S.C. 154(b) by 260 days.

(21) Appl. No.: 14/669,083

(22) Filed: Mar. 26, 2015

(65) Prior Publication Data

US 2016/0281979 A1 Sep. 29, 2016

(51) Int. Cl.

| | |
|---|---|
| ***F23R 3/28*** | (2006.01) |
| ***F23D 14/02*** | (2006.01) |
| ***F23D 14/34*** | (2006.01) |
| ***F23D 14/58*** | (2006.01) |
| ***F23R 3/14*** | (2006.01) |
| ***F23R 3/26*** | (2006.01) |

(52) U.S. Cl.

CPC ..... *F23D 14/02* (2013.01); *F23D 14/34* (2013.01); *F23D 14/58* (2013.01); *F23R 3/14* (2013.01); *F23R 3/26* (2013.01); *F23R 3/286* (2013.01)

(58) Field of Classification Search

CPC ..... F23R 3/14; F23R 3/26; F23R 3/28

USPC ..... 431/353, 4, 352; 60/39.32, 39.65, 740

See application file for complete search history.

(56) References Cited

U.S. PATENT DOCUMENTS

| | | | | |
|---|---|---|---|---|
| 4,008,568 A * | 2/1977 | Spears, Jr. | F23R 3/60 | 431/352 |
| 4,050,240 A * | 9/1977 | Vaught | F23R 3/26 | 431/352 |
| 4,365,470 A * | 12/1982 | Matthews | F23R 3/283 | 60/740 |
| 4,464,108 A * | 8/1984 | Korenyi | F23D 11/408 | 239/402 |
| 4,842,197 A * | 6/1989 | Simon | F23C 7/002 | 239/400 |

(Continued)

*Primary Examiner* — Gregory Huson
*Assistant Examiner* — Nikhil Mashruwala
(74) *Attorney, Agent, or Firm* — Hovey Williams LLP; Peter C. Knops

(57) ABSTRACT

The present invention discloses a novel apparatus and way for directing a supply of compressed air into a fuel nozzle assembly for mixing with a fuel source. The apparatus comprises a fuel nozzle assembly having a plurality of coaxial tubes and radially-extending swirler vanes for directing a supply of fuel to a mixing tube. Compressed air is directed to flow in a primarily axial direction by passing through a hemispherically-shaped dome portion at an air inlet region of the fuel nozzle assembly. The hemispherically-shaped dome includes a plurality of openings for directing air into the fuel nozzle assembly in a direction having a radial and axial component.

5 Claims, 9 Drawing Sheets

(56) References Cited

U.S. PATENT DOCUMENTS

| | | | | |
|---|---|---|---|---|
| 5,987,889 | A * | 11/1999 | Graves | F23C 7/004 60/746 |
| 6,438,961 | B2 * | 8/2002 | Tuthill | F23C 7/004 60/737 |
| 6,478,577 | B1 * | 11/2002 | Maricic | F23D 14/04 239/552 |
| 2014/0114652 | A1 * | 4/2014 | Kishi | G10L 19/032 704/205 |

* cited by examiner

FUEL NOZZLE WITH HEMISPHERICAL DOME AIR INLET

CROSS-REFERENCE TO RELATED APPLICATIONS

Not applicable.

TECHNICAL FIELD

The present invention relates generally to an apparatus and method for directing a flow of compressed air into a fuel nozzle assembly. More specifically, a fuel nozzle assembly is provided with a flow directing device at an air inlet region.

BACKGROUND OF THE INVENTION

In an effort to reduce the amount of pollution emissions from gas-powered turbine engines, governmental agencies have enacted numerous regulations requiring reductions in the amount of oxides of nitrogen (NOx) and carbon monoxide (CO) produced. Lower combustion emissions can often be attributed to a more efficient combustion process, with specific regard to fuel injector location, airflow rates, and mixing effectiveness.

Early combustion systems utilized diffusion type nozzles, where fuel is mixed with air external to the fuel nozzle by diffusion, proximate the flame zone. Diffusion type nozzles historically produce relatively high emissions due to the fact that the fuel and air burn essentially upon interaction, without mixing, and stoichiometrically at high temperature to maintain adequate combustor stability and low combustion dynamics.

An enhancement in combustion technology is the concept of premixing fuel and air prior to combustion to form a homogeneous mixture that burns at a lower temperature than a diffusion type flame and thereby produces lower NOx emissions. Premixing can occur either internal to the fuel nozzle assembly or external thereto, as long as it is upstream of the combustion zone. An example of a premixing combustor has a plurality of fuel nozzle assemblies, each injecting fuel into a premix chamber where fuel mixes with compressed air from a plenum before entering a combustion chamber. Premixing fuel and air together before combustion allows for the fuel and air to form a more homogeneous mixture, which, when ignited will burn more completely, resulting in lower emissions. However, the thoroughness and completeness of the mixing and resulting burning of the fuel-air mixture depends on the effectiveness of the mixing.

SUMMARY

The present invention discloses an apparatus and method for improving the air supply for mixing with fuel being injected through a fuel nozzle assembly. More specifically, in an embodiment of the present invention, a fuel nozzle assembly is disclosed comprising a plurality of concentric tubes forming first, second and third passageways. The fuel nozzle assembly also comprises a premix tube coaxial to and radially outward of a third tube, the premix tube having a plurality of swirler vanes contained therein for inducing a swirl into a passing flow of air and fuel. The fuel nozzle assembly further comprises a hemispherically-shaped dome extending around an inlet end of the premix tube positioned towards a base of the fuel nozzle assembly, and having a plurality of openings oriented in both an axial and radial component.

In an alternate embodiment of the present invention, an air conditioning screen for use in a fuel nozzle assembly is disclosed. The air conditioning screen comprises a generally hemispherically-shaped dome positioned about an air inlet region of a fuel nozzle assembly. The hemispherically-shaped dome has a plurality of openings, or holes, extending from an outer wall through to an inner wall and angled downstream having both an axial and radial component. The hemispherically-shaped dome also has a plurality of pins positioning the hemispeherically-shaped dome relative to a premix tube of the fuel nozzle assembly.

In yet another embodiment of the present invention, a method of conditioning an incoming air stream entering a fuel nozzle assembly is disclosed. The method generally comprises providing a flow of compressed air to a region surrounding the fuel nozzle assembly, the fuel nozzle assembly having a hemispherical dome at an air inlet region. A first portion of the compressed air is directed through a plurality of cooling holes, or openings, in the hemispherically-shaped dome portion and while a second portion of the compressed air through an annular opening at a region between the hemispherically-shaped dome and a premix tube of the fuel nozzle assembly.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The present invention discloses a fuel nozzle assembly for use in a gas turbine combustion system for use in a premix combustion system to help reduce emissions from the combustion system as shown in detail in FIGS. 1-9. As one skilled in the art understands, a gas turbine engine typically incorporates a plurality of combustors. Generally, for the purpose of discussion, the gas turbine engine may include low emission combustors such as those disclosed herein and may be arranged in a can-annular configuration about the gas turbine engine. One type of gas turbine engine (e.g., heavy duty gas turbine engines) may be typically provided with, but not limited to, six to eighteen individual combustors, each of them fitted with the components outlined above. Accordingly, based on the type of gas turbine engine, there may be several different fuel circuits utilized for operating the gas turbine engine. Each combustor includes one or more fuel nozzle assemblies for supplying the fuel for generating the hot combustion gases.

Emissions from a combustion system are based in part on how completely the fuel and air mix and then burn, or combust. In order to minimize the emissions and maximize the burning of the fuel that is being injected, it is preferable that the fuel and air are thoroughly mixed. To ensure thorough mixing, one factor considered is the condition of the air mixing with the fuel.

Figure 1:
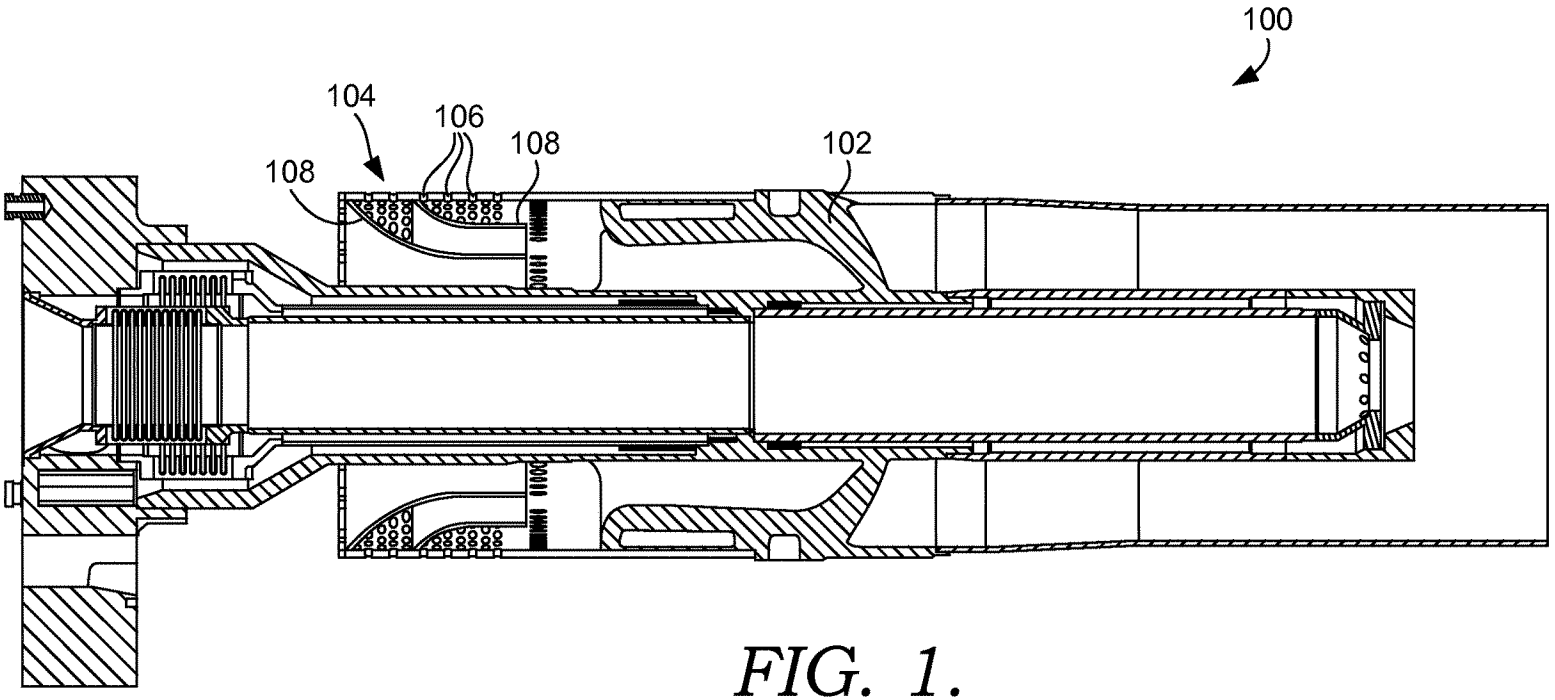
FIG. 1. PRIOR ART
FIG. 1 is a cross section of a fuel nozzle assembly in accordance with the prior art.

Referring specifically to FIG. 1, a fuel nozzle assembly 100 of the prior art is shown in cross section. The fuel nozzle assembly 100 is similar to that of U.S. Pat. No. 6,438,961 assigned to the General Electric Co. The fuel nozzle assembly 100 provides a swirler 102 for injecting fuel into a passing air flow and an inlet flow conditioner 104 for directing the flow radially inward through a series of holes 106. The inlet flow conditioner 104 comprises a cylindrical wall portion and an end wall perpendicular to the cylindrical portion. The flow is turned axially through a plurality of turning vanes 108. However improved conditioning of the incoming airflow to the fuel nozzle assembly can be achieved through a simpler geometry.

An improved way of treating the incoming air flow to a fuel nozzle assembly is discussed below with respect to FIGS. 2-9, which are not drawn to scale, but are merely representative of the present invention. The fuel nozzle assembly 200 is in accordance with an embodiment of the invention. More specifically, referring to FIGS. 2 and 3, the fuel nozzle assembly 200 comprises a first tube 202 extending along a center axis A-A and having a first passageway 204 formed within the first tube 202. The first passageway 204, depending upon the operation of a combustion system contains either a liquid, gas, air, or mixture thereof for purging the first passageway 204, where the contents of the first passageway 204 are directed towards a tip region 205 of the fuel nozzle assembly 200. Depending on the configuration of the fuel nozzle assembly 200, the first tube 202 can also include a blank or dual fuel cartridge extending within the first tube 202 and along the center axis A-A, where the cartridge may be purged with air. The cartridge, although not depicted, is sized to then also aid in establishing the correct size of the corresponding first passageway 204 for the gas or purge.

Coaxial to and radially outward of the first tube 202 is a second tube 206. A second passageway 208 is formed between the first tube 202 and the second tube 206. The second passageway 208 extends coaxial to the first passageway 204 to within approximately the swirler vanes 220, as discussed below. The second passageway 208 contains a gas fuel, air, or mixture thereof, directed to the swirler vanes 220, as discussed below.

The fuel nozzle assembly 200 also comprises a third tube 210 which is coaxial to and radially outward of the second tube 206, thereby forming a third passageway between a portion of the second tube 206 and the third tube 210 as well as between a portion of the first tube 202 and the third tube 210. That is, the third passageway is split into two portions, 212A and 212B, which do not communicate with each other. A first portion 212A extends from a base 224 of the fuel nozzle assembly 200 to proximate the swirler vanes 220. A second portion 212B extends from proximate the swirler vanes 220 to the tip region 205 of the fuel nozzle assembly 200. A gas flows through the first portion 212A, where the gas initially travels axially through the first portion 212A and then radially outward through the swirler vanes 220, where it is injected into a surrounding air stream. The second portion 212B flows air, fuel, or a mixture thereof, which is drawn into the second portion 212B at the region adjacent to the swirler vanes 220, through air inlet holes 221. The air, fuel, or mixture thereof then passes axially through the second portion 212B to the tip region 205 of the fuel nozzle assembly 200, where it serves to mix with the diffusion gas from the first passageway 204 proximate the tip region 205.

Figure 3:
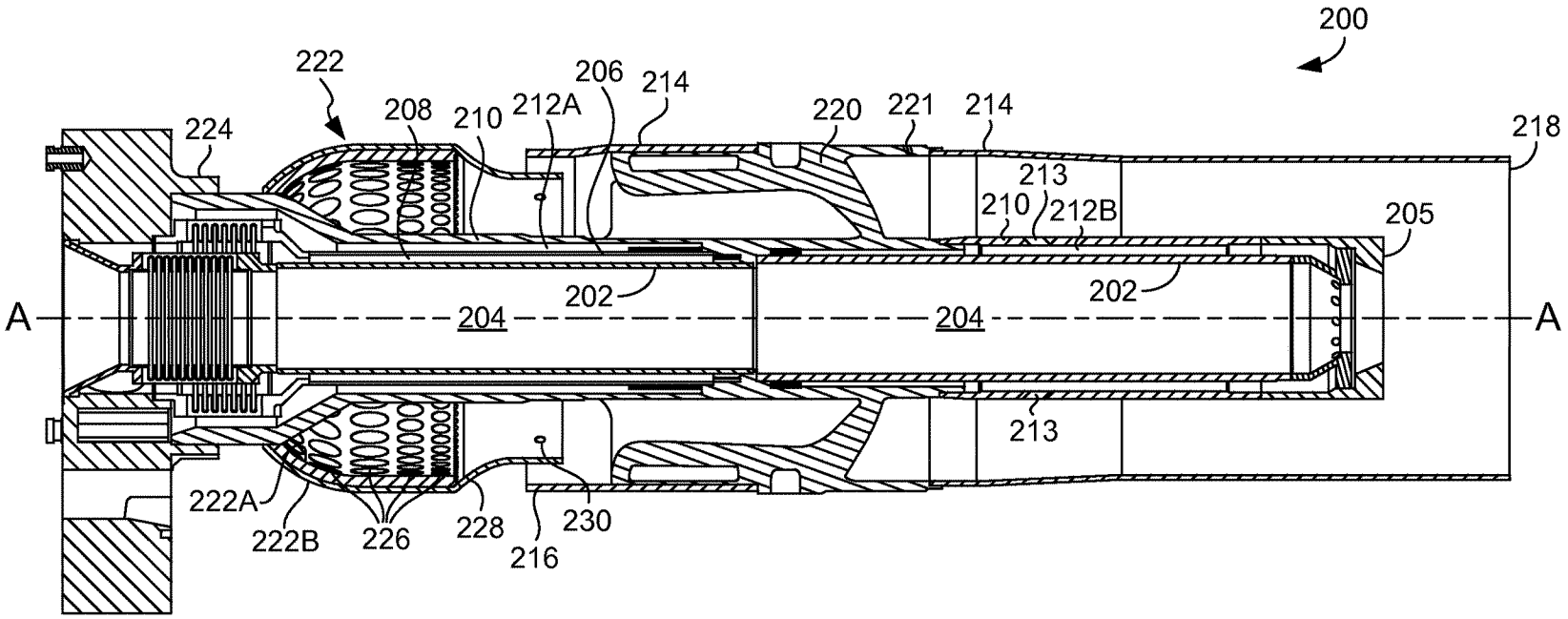
FIG. 3 is a cross section of the fuel nozzle assembly of FIG. 2 in accordance with an embodiment of the present invention.
Figure 6:
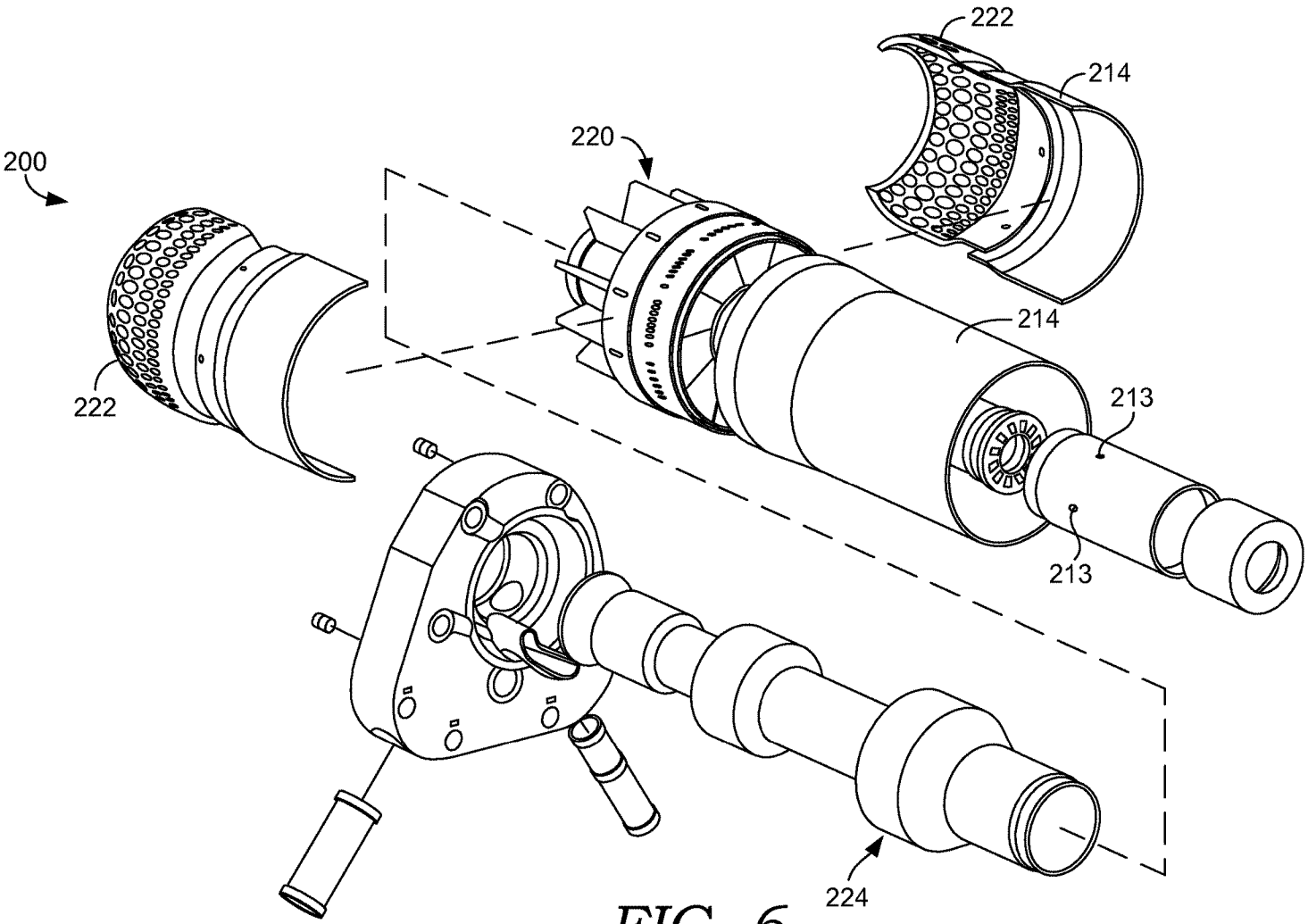
FIG. 6 is an exploded view of the fuel nozzle assembly of FIG. 2 in accordance with an embodiment of the present invention.
Figure 7:
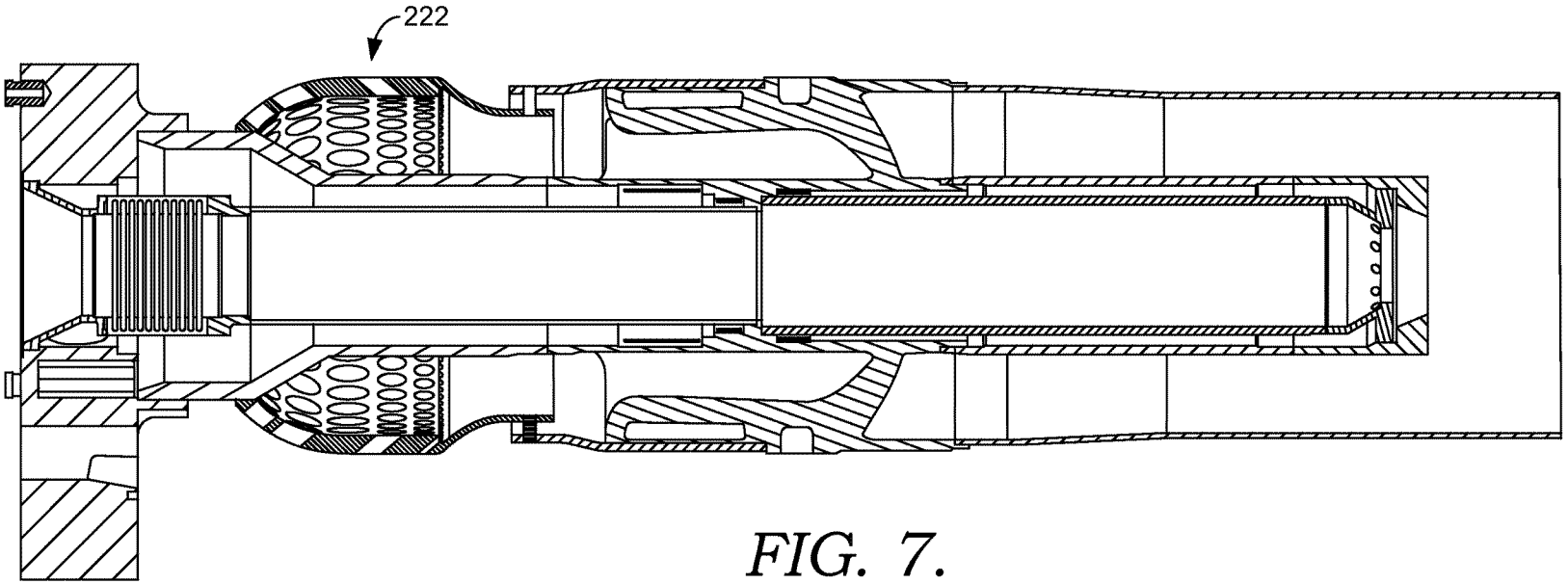
FIG. 7 is a cross section view of a fuel nozzle assembly in accordance with an alternate embodiment of the present invention.

In an alternate embodiment of the present invention, a fuel-air mixture can be provided to second portion 212B for injection through the tip of the fuel nozzle assembly. This is shown in FIGS. 3 and 6. The second portion 212B can flow a gaseous fuel, air, or mixture thereof. In order to supply second portion 212B with a flow of fuel, it is necessary for the second portion 212B to be in fluid communication with the fuel-air mixture resulting from the plurality of swirler vanes 220. A fuel mixture can be supplied to the second portion 212B through one or more holes 213 located in the third tube 210. The one or more holes 213 can be oriented at an angle or perpendicular to the surface of the third tube 210.

Figure 9:
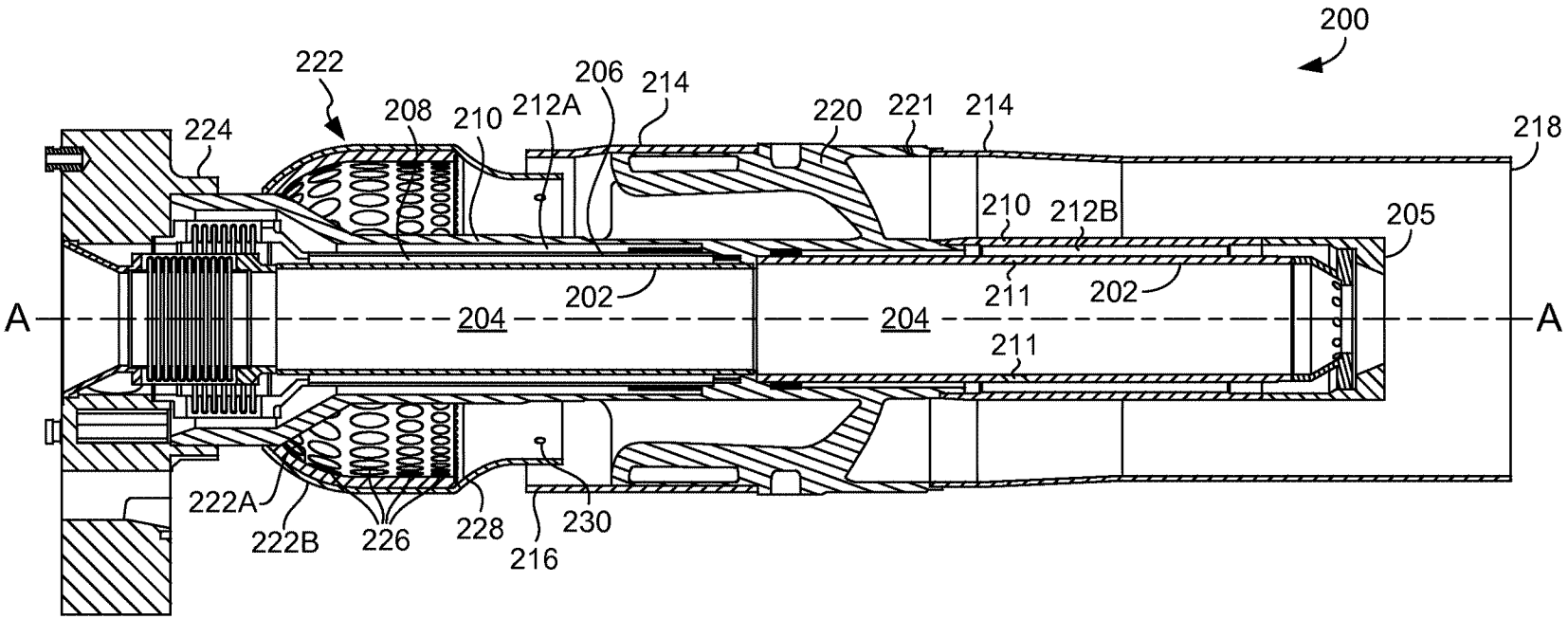
FIG. 9 is a cross section of a fuel nozzle assembly of FIG. 2 in accordance with another alternate embodiment of the present invention.

Referring to FIG. 9, yet another alternate embodiment of the fuel nozzle assembly is depicted. As discussed above, second portion 212B can pass a fuel-air mixture to the tip region 205. However, this fuel can be provided to second portion 212B through an alternate means, such as through holes 211 in the first tube 202. As such, fuel from first passageway 204 passes through holes 211 and into second portion 212B.

Referring back to FIG. 3, the fuel nozzle assembly 200 also comprises a premix tube 214 positioned coaxial to and radially outward of the third tube 210. The premix tube 214 has an inlet end 216 and an opposing outlet end 218. A plurality of swirler vanes 220 extend radially between the third tube 210 and premix tube 214. The plurality of swirler vanes 220 are positioned about the center core of coaxial tubes of the fuel nozzle assembly 200 and provide a way of injecting and mixing fuel and air together to induce a swirl, as discussed further below.

Figure 4:
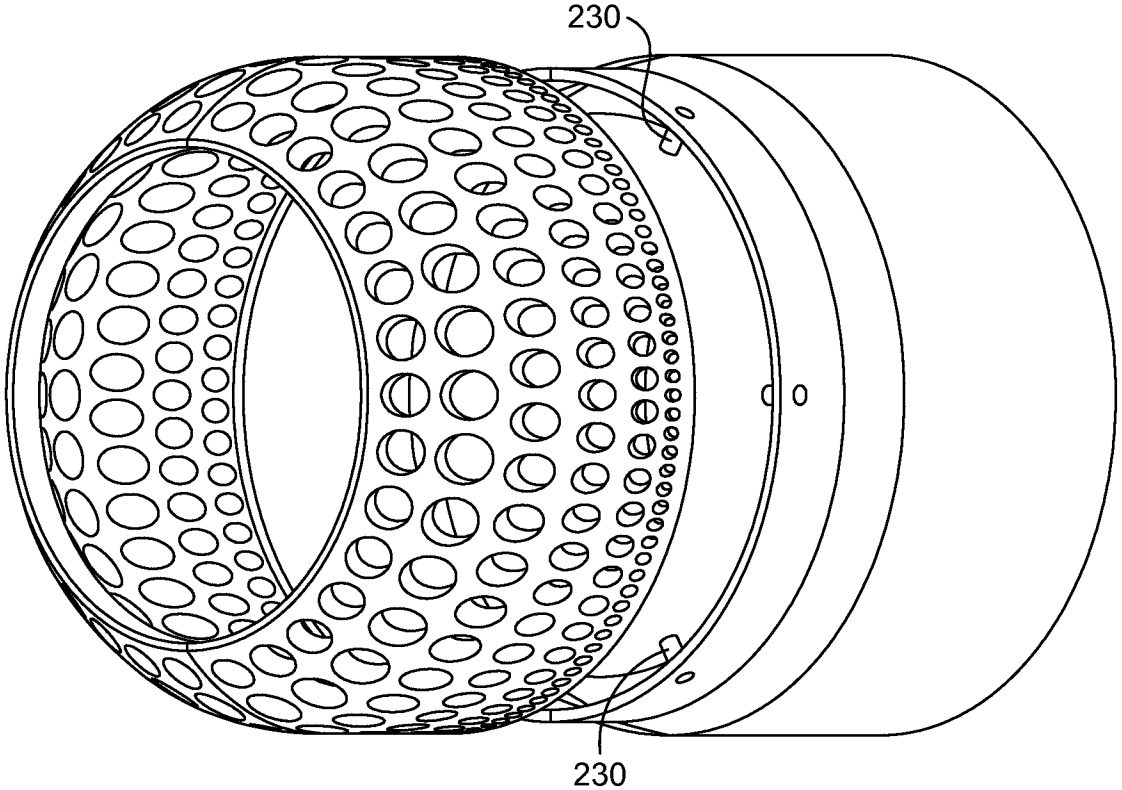
FIG. 4 is a perspective view of a portion of the fuel nozzle assembly in accordance with an embodiment of the present invention.
Figure 5:
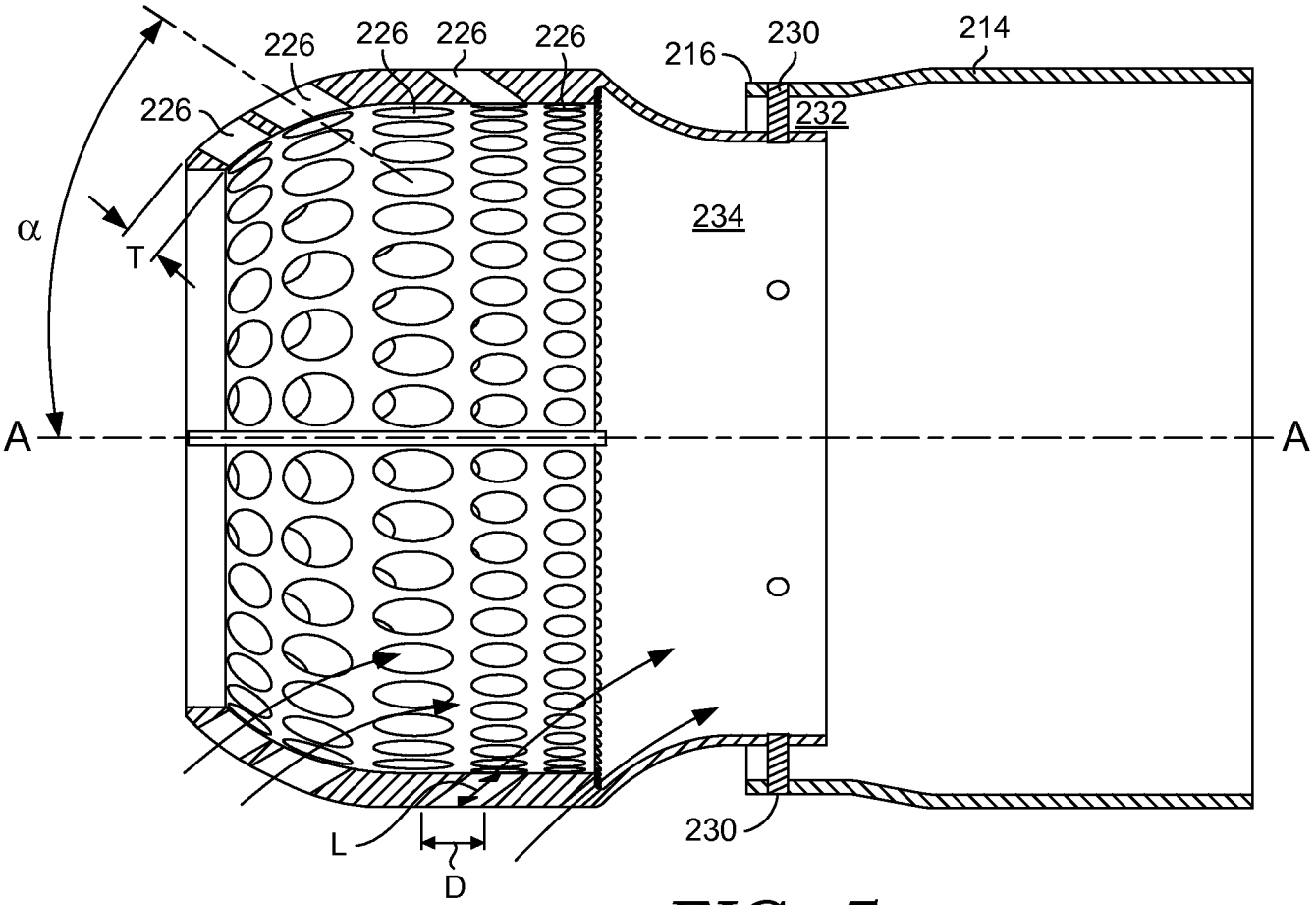
FIG. 5 is a cross section view through the portion of the fuel nozzle assembly of FIG. 4 in accordance with an embodiment of the present invention.

The fuel nozzle assembly 200 also comprises a hemispherically-shaped dome 222 extending from approximately the inlet end 216 of the premix tube 214 towards the base 224 of the fuel nozzle assembly 200. The hemispherically-shaped dome 222 provides an improved way of conditioning the incoming air flow into the fuel nozzle assembly 200, compared to the prior art. More specifically, as shown in FIGS. 3-5, the hemispherically-shaped dome 222 tapers in radius from a cylindrical profile near inlet end 216 of premix tube 214 to a conical profile near the base 224. Like other components of the fuel nozzle assembly 200, the hemispherically-shaped dome 222 may be fabricated from a steel or nickel-based alloy, such as a stainless steel, as it operates at a relatively low temperature, that of the temperature of compressed air passing therethrough. The hemispherically-shaped dome 222, while having a cylindrical and conical shape, can be formed from multiple manufacturing techniques such as casting and rolling and welding of sheet metal.

Figure 2:
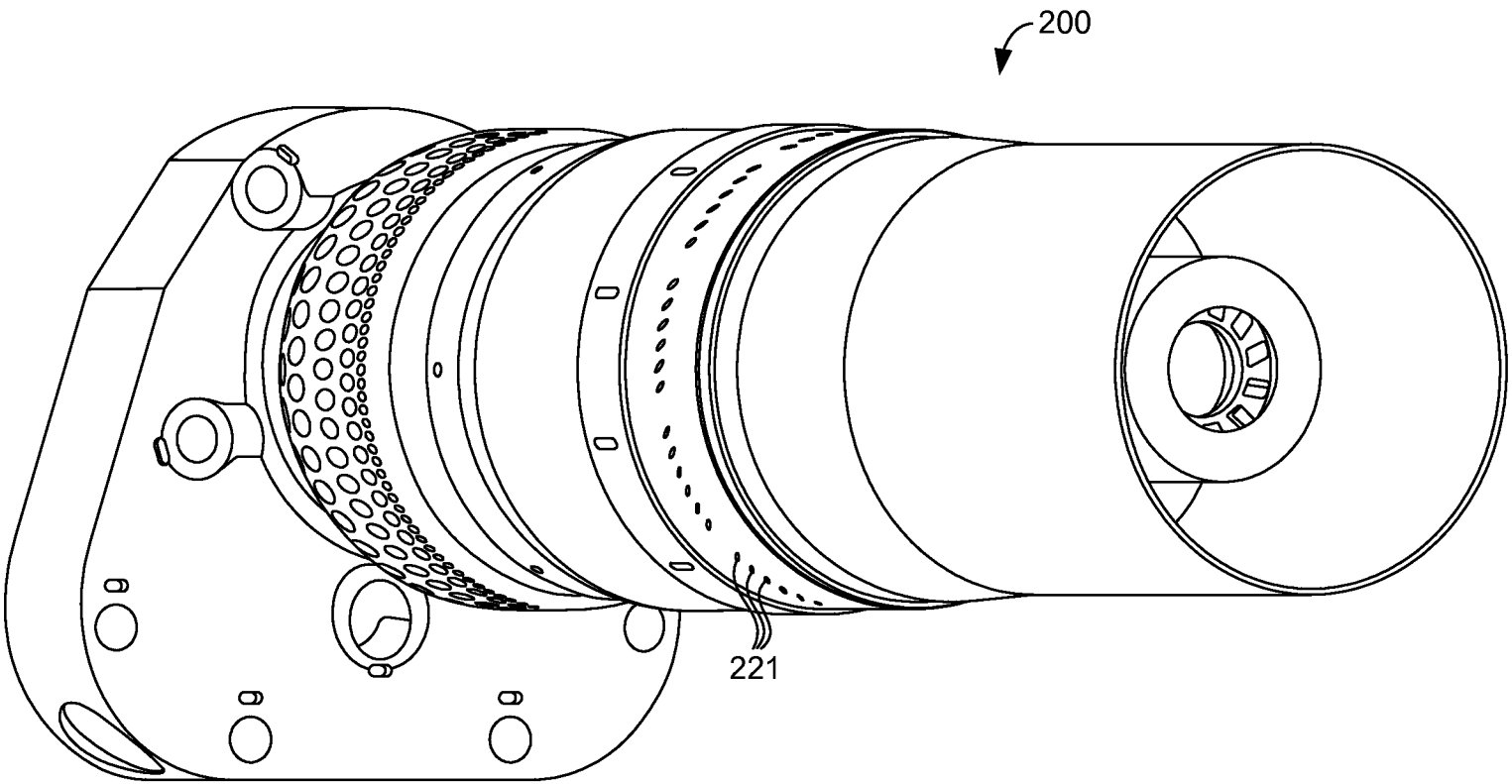
FIG. 2 is a perspective view of a fuel nozzle assembly in accordance with an embodiment of the present invention.

Referring to FIGS. 2, 3, and 5, the hemispherically-shaped dome 222 has an inner wall 222A spaced a distance apart from an outer wall 222B, thereby forming a hemispherically-shaped dome wall thickness T. The thickness T of the hemispherically-shaped dome wall can vary, but is in the range of approximately 0.060 inches to 0.75 inches thick. A sufficient hemispherically-shaped dome wall thickness T is necessary in order to direct the compressed air into the fuel nozzle assembly 200 in the desired direction. That is, the hemispherically-shaped dome 222 also comprises a plurality of openings 226, or air holes, extending between the walls 222A and 222B. The openings 226 can be placed in the hemispherically-shaped dome 222 through a variety of machining techniques.

Referring now to FIG. 5, the openings 226 are oriented in a generally downstream direction, or a direction towards the swirler vanes 220, such that each of the openings 226 has both an axial and radial component. Each of the openings 226 direct compressed air therethrough with each of the plurality of air holes, or openings 226, having a length L and a diameter D. In order to ensure the compressed air is directed substantially downstream towards the fuel injection regions, it is desirable for the length L to be greater than the diameter D. Such a length L to diameter D relationship is possible when the wall thickness T of the generally hemispherically-shaped dome 222 is of sufficient thickness so the openings 226 can be angled so as to provide the desired axial component to the flow direction of the air.

For the embodiment depicted in FIGS. 2-5, the openings 226 are arranged in six axially spaced rows, with the openings 226 oriented at an angle $\alpha$ ranging up to approximately 90 degrees relative to the center axis A-A. Generally, the angle of the openings 226 is less than 45 degrees; however angles upwards of 90 degrees can be used where an upstream flow of air can be used to help turn a stream of air being injected at an angle upwards of 90 degrees. However, it is important to note that the present invention is not limited to such a configuration, as the exact quantity, diameter, surface angle, and position of the openings 226 can vary depending on the amount of compressed air to be injected into the fuel nozzle assembly 200 and the desired air distribution pattern. A combination of the opening angle $\alpha$ and the thickness T of the hemispherically-shaped dome 222 provide an effective way of directing the flow of compressed air, such that the turning vanes 108 of the prior art fuel nozzle are not necessary. The combined cylindrical and conical shape of the dome 222 provide an increased surface area for openings 226 compared to the prior art.

Coupled to the hemispherically-shaped dome 222, between the dome 222 and the premix tube 214, is an annular plate 228. The annular plate 228 has a curved and cylindrical cross sectional shape and may be secured to the generally hemispherically-shaped dome 222 at one end and positioned within the inlet end 216 of the premix tube 214 at an opposing end. The annular plate 228 may be held in place in part due to a plurality of generally radially-extending pins 230 positioned between the cylindrical portion of the annular plate 228 and the premix tube 214. In an alternate embodiment of the present invention, the annular plate 228 is not secured to the hemispherically-shaped dome 222, but instead the hemispherically-shaped dome 222 is secured to the base 224. The annular plate 228 provides an alternate air inlet region for a portion of the compressed air into the fuel nozzle assembly 200. Furthermore, the annular plate 228 serves to split the compressed air between an outer region 232 and an inner region 234. However, as it can be clearly seen from FIGS. 3-5, a majority of the compressed air entering the premix tube 214 of the fuel nozzle assembly 200 does so through the hemispherically-shaped dome 222.

Additional details regarding the fuel nozzle assembly 200 can be seen in FIG. 6. More specifically, the fuel nozzle assembly 200 is shown in an exploded view with the hemispherically-shaped dome 222 shown in a split form in order to better show some of the internal components of the fuel nozzle assembly 200, such as the swirler vanes 220.

The present invention provides a hemispherically-shaped dome 222 for use with an improved fuel nozzle assembly 200. However, it is envisioned that the hemispherically-shaped dome 222 can be used with a variety of fuel nozzle assemblies. The fuel nozzle assembly 200 of the present invention is configured to operate at least within a Dry-Low Nox (DLN) combustion system. However, the DLN combustion system can operate with alternate fuel nozzle assemblies. The hemispherically-shaped dome 222 can be used with alternate fuel nozzles, such as the fuel nozzle depicted in FIG. 7.

Figure 8:
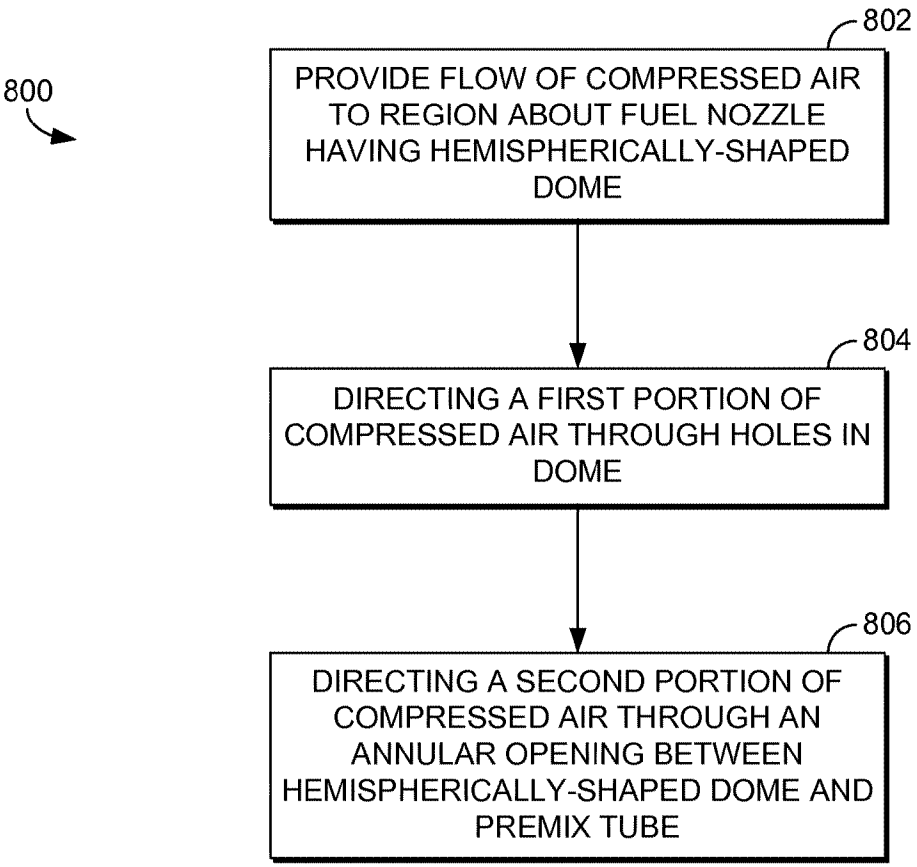
FIG. 8 is diagram depicting a method of conditioning an incoming airflow entering a fuel nozzle assembly.

Referring now to FIG. 8, a method 800 of conditioning an incoming air stream to a fuel nozzle assembly is disclosed. The method comprises a step 802 in which a flow of compressed air is provided to a region surrounding the fuel nozzle assembly, where the fuel nozzle assembly also includes a hemispherically-shaped dome, as discussed above. As one skilled in the art understands, a gas turbine combustor typically includes at least one fuel nozzle assembly for injecting and mixing fuel and air together. As such, the fuel nozzle assembly is typically positioned within a flow of compressed air.

In a step 804, a first portion of the compressed air is directed through a plurality of cooling holes, or openings, in the hemispherically-shaped dome portion. The openings in the hemispherically-shaped dome are arranged in a plurality of axially-spaced rows and oriented at an angle relative to the center axis A-A of the fuel nozzle assembly so as to direct the flow of compressed air in a generally axial direction upon exiting the hemispherically-shaped dome and entering the premix tube.

In a step 806, a second portion of the compressed air is directed through a region between the hemispherically-shaped dome and a premix tube of the fuel nozzle assembly. More specifically, an annular plate having a cylindrical portion and a curved cross section is spaced axially and radially from the inlet end of the premix tube to direct a portion of the compressed air through an annular opening into the fuel nozzle assembly. However, as discussed above, the majority of the compressed air is directed into the fuel nozzle assembly by way of the openings in the hemispherically-shaped dome.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. An air conditioning screen for use in a fuel nozzle assembly comprising:

a substantially hemispherically-shaped dome comprising:

an inner wall;

an outer wall; and, a plurality of openings extending from the outer wall to the inner wall and angled in a downstream direction having both an axial and radial component;

wherein the substantially hemispherically-shaped dome encompasses an air inlet region of a fuel nozzle assembly, wherein at least one of the plurality of air openings has a length and a diameter, with the length greater than the diameter, and wherein the substantially hemispherically-shaped dome extends between a base of the fuel nozzle assembly and proximate a premix tube of the fuel nozzle assembly.

2. The air conditioning screen of claim 1, wherein the first plurality of openings are located in at least two axially spaced rows.

3. The air conditioning screen of claim 2, wherein the substantially hemispherically-shaped dome has a thickness ranging between approximately 0.060 inches and 0.75 inches.

4. The air conditioning screen of claim 1 further comprising an annular plate having a curved cross sectional shape secured to the substantially hemispherically-shaped dome.

5. The air conditioning screen of claim 4, wherein the annular plate is spaced from the premix tube by a plurality of radially extending pins or struts.

* * * * *